US011905089B2

(12) United States Patent
Smith

(10) Patent No.: US 11,905,089 B2
(45) **Date of Patent: *Feb. 20, 2024**

(54) ULTRASECURE CARD PACKAGE

(71) Applicant: CPI CARD GROUP—MINNESOTA, INC., Roseville, MN (US)

(72) Inventor: Dennis R. Smith, Minnetonka, MN (US)

(73) Assignee: CPI CARD GROUP—MINNESOTA, INC., Roseville, MN (US)

( * ) Notice: Subject to any disclaimer, the term of this patent is extended or adjusted under 35 U.S.C. 154(b) by 101 days.

This patent is subject to a terminal disclaimer.

(21) Appl. No.: 17/587,994

(22) Filed: Jan. 28, 2022

(65) Prior Publication Data

US 2022/0153495 A1 May 19, 2022

Related U.S. Application Data

(63) Continuation of application No. 16/879,573, filed on May 20, 2020, now Pat. No. 11,267,628, which is a (Continued)

(51) Int. Cl.
*B65D 75/30* (2006.01)
*B65D 65/40* (2006.01)

(Continued)

(52) U.S. Cl.
CPC ..... *B65D 75/30* (2013.01); *A45C 11/00* (2013.01); *B65B 61/18* (2013.01); *B65D 65/40* (2013.01);

(Continued)

(58) Field of Classification Search
CPC ..... B65D 75/30; B65D 75/26; B65D 65/40
See application file for complete search history.

(56) References Cited

U.S. PATENT DOCUMENTS 2,955,331 A 10/1960 Nelson
3,217,462 A 11/1965 Watts (Continued)

FOREIGN PATENT DOCUMENTS

AU 2002258912 B2 12/2006
AU 2006304041 A1 4/2007

(Continued)

OTHER PUBLICATIONS

"Handbook of Paper and Wood Packaging Technology", 2005.

(Continued)

*Primary Examiner* — Chelsea E Stinson
(74) *Attorney, Agent, or Firm* — Dorsey & Whitney LLP

(57) ABSTRACT

A package for a point of sale card that includes a first panel, a second panel coupled to the first panel by an activatable adhesive applied to one of the first panel or the second panel, and a card enclosure region defined between the first panel and the second panel, the card enclosure region configured to receive a point of sale card therein. The activatable adhesive is selectively activated along a perimeter surrounding the card enclosure region to secure the first panel and the second panel together at the perimeter and prevent access to the card enclosure region without irreparable damage to the first panel or the second panel.

17 Claims, 4 Drawing Sheets

Related U.S. Application Data continuation of application No. 14/704,067, filed on May 5, 2015, now Pat. No. 11,034,497, which is a continuation of application No. 13/852,286, filed on Mar. 28, 2013, now Pat. No. 9,049,909, which is a continuation of application No. 13/083,178, filed on Apr. 8, 2011, now Pat. No. 8,419,889, which is a continuation of application No. 12/017,227, filed on Jan. 21, 2008, now abandoned.

(51) Int. Cl.

| | |
|---|---|
| ***B65D 75/56*** | (2006.01) |
| ***B65B 61/18*** | (2006.01) |
| ***B65D 75/26*** | (2006.01) |
| ***A45C 11/00*** | (2006.01) |

(52) U.S. Cl.

CPC ..... *B65D 75/26* (2013.01); *B65D 75/563* (2013.01); *B65D 2575/565* (2013.01); *Y10T 29/49982* (2015.01); *Y10T 156/1089* (2015.01)

(56) References Cited

U.S. PATENT DOCUMENTS 3,259,507 A 7/1966 Smith
3,450,256 A 6/1969 Chandler et al.
3,464,541 A 9/1969 Papendick et al.
3,476,239 A 11/1969 Jacob
3,498,018 A 3/1970 Seiferth et al.
3,616,898 A 11/1971 Massie
3,734,798 A 5/1973 Dooley
3,840,396 A 10/1974 Sommerfeld et al.
3,939,625 A 2/1976 Remele et al.
4,120,445 A 10/1978 Carrier et al.
4,125,190 A 11/1978 Davie et al.
4,226,658 A 10/1980 Carlson et al.
4,258,848 A 3/1981 Akao et al.
4,337,589 A 7/1982 Volkert et al.
4,429,792 A 2/1984 Machbitz
4,497,941 A 2/1985 Aliani et al.
4,513,993 A 4/1985 Brown
4,544,590 A 10/1985 Egan
4,565,733 A 1/1986 Akao
4,650,079 A 3/1987 Tani
4,687,692 A 8/1987 Akao
4,712,690 A 12/1987 Stoehr
4,720,011 A 1/1988 Canamero
4,824,498 A 4/1989 Goodwin et al.
4,890,872 A 1/1990 Parrotta et al.
4,985,299 A 1/1991 Clerici
5,000,810 A 3/1991 Silverstein
5,018,337 A 5/1991 Carter et al.
5,077,104 A 12/1991 Hunt et al.
5,091,261 A 2/1992 Casey et al.
5,100,181 A 3/1992 Nathans et al.
5,257,491 A * 11/1993 Rouyer ..... C09J 175/04 53/436
5,360,116 A 11/1994 Schmiletzky
5,418,008 A 5/1995 Calvert
5,427,832 A 6/1995 Longtin
5,438,928 A 8/1995 Chatwin et al.
5,480,701 A 1/1996 Hiroi
5,485,917 A 1/1996 Early
5,605,230 A 2/1997 Marino et al.
5,609,253 A 3/1997 Goade
5,613,349 A 3/1997 Brown
5,650,209 A 7/1997 Ramsburg et al.
5,658,629 A 8/1997 Delcuve et al.
5,699,956 A 12/1997 Brennan
5,760,381 A 6/1998 Stich et al.
5,762,263 A 6/1998 Chamberlain, IV
5,777,305 A 7/1998 Smith et al.
5,791,474 A 8/1998 Hansen
5,794,409 A 8/1998 Akridge et al.
5,804,026 A 9/1998 Vogt
5,830,548 A 11/1998 Anderson et al.
5,863,977 A 1/1999 Fischer et al.
5,882,746 A 3/1999 Hoffman
5,884,456 A 3/1999 Hansen
5,918,909 A 7/1999 Fiala et al.
5,975,302 A 11/1999 Young
5,984,099 A 11/1999 Shimizu et al.
6,010,784 A 1/2000 Peterson
6,013,363 A 1/2000 Takahashi et al.
6,083,616 A 7/2000 Dressler
6,090,728 A 7/2000 Yenni et al.
6,099,682 A 8/2000 Krampe et al.
6,109,439 A 8/2000 Goade
6,153,278 A 11/2000 Timmerman et al.
6,161,699 A 12/2000 Gartland
6,179,201 B1 1/2001 Chess
6,224,108 B1 5/2001 Klure
6,270,012 B1 8/2001 Dawson
6,302,027 B1 10/2001 Compton et al.
6,315,206 B1 11/2001 Hansen et al.
6,328,341 B2 12/2001 Klure
6,332,537 B1 12/2001 Usui et al.
6,349,829 B1 2/2002 Matheis et al.
6,364,113 B1 4/2002 Faasse et al.
6,439,613 B2 8/2002 Klure
6,454,165 B1 9/2002 Dawson
6,518,359 B1 2/2003 Clemens et al.
6,543,809 B1 4/2003 Kistner et al.
6,571,953 B2 6/2003 Sherline et al.
6,588,591 B1 7/2003 Schabert et al.
6,593,407 B2 7/2003 Haner et al.
6,619,480 B2 9/2003 Smith
6,640,974 B2 11/2003 Malone
6,715,795 B2 4/2004 Klure
6,736,267 B2 5/2004 Schamante
6,746,712 B2 6/2004 Hoffmann et al.
6,756,095 B2 6/2004 Sandt et al.
6,818,269 B2 11/2004 Quinn et al.
6,843,874 B1 1/2005 Janssen
6,845,863 B1 1/2005 Riley
6,890,982 B2 5/2005 Borsinger et al.
6,902,518 B2 6/2005 Bretl
6,908,687 B2 6/2005 Mendes et al.
6,957,737 B1 10/2005 Frederickson et al.
6,989,407 B2 1/2006 Lapin
7,000,844 B1 2/2006 Smith
7,011,249 B2 3/2006 Tang
7,017,946 B2 3/2006 Behnen
7,051,876 B2 5/2006 Grosskopf
7,144,603 B2 12/2006 Nageli et al.
7,144,635 B2 12/2006 Hawes et al.
7,165,676 B2 1/2007 Dalessandro
7,170,409 B2 1/2007 Ehrensvaerd et al.
7,188,728 B2 3/2007 Williams-Hartman
7,199,180 B1 4/2007 Simmons et al.
7,207,441 B2 4/2007 Ritter
7,222,797 B2 5/2007 Davila et al.
7,223,814 B2 5/2007 Martin et al.
7,235,294 B2 6/2007 Story
7,262,251 B2 8/2007 Kanderski et al.
7,267,284 B1 9/2007 Smith
7,288,164 B2 10/2007 Roberge et al.
7,326,315 B2 2/2008 Behnen
7,524,911 B2 4/2009 Karjala et al.
7,544,266 B2 6/2009 Sangkaratana et al.
7,571,810 B2 8/2009 Tilton
7,621,400 B2 11/2009 Smith et al.
7,645,829 B2 1/2010 Tse et al.
7,718,026 B2 5/2010 Alexander
7,722,939 B2 5/2010 Schwantes et al.
7,722,940 B2 5/2010 Schwantes et al.
7,726,480 B2 6/2010 Nazari
7,726,481 B2 6/2010 Grosskopf
7,726,486 B2 6/2010 Jones
7,812,085 B2 10/2010 Tse et al.
7,824,029 B2 11/2010 Jones et al.
7,838,590 B2 11/2010 Kanderski
7,896,161 B2 3/2011 Reilley et al.

(56) References Cited

U.S. PATENT DOCUMENTS

| | | | | |
|---|---|---|---|---|
| 7,941,948 | B2 | 5/2011 | Bardolph et al. | |
| 8,110,623 | B2 | 2/2012 | Ahmed et al. | |
| 8,177,066 | B2 | 5/2012 | Tilton | |
| 8,225,933 | B2 | 7/2012 | Wade | |
| 8,256,682 | B2 | 9/2012 | Chakiris et al. | |
| 8,287,949 | B2 | 10/2012 | Maak et al. | |
| 8,366,865 | B2 | 2/2013 | Terfloth et al. | |
| 8,419,889 | B2 | 4/2013 | Smith | |
| 8,800,758 | B2 | 8/2014 | Roberts | |
| 8,915,366 | B2 | 12/2014 | Smith | |
| 8,925,823 | B2 | 1/2015 | Chakiris et al. | |
| 9,049,909 | B2 | 6/2015 | Smith | |
| 11,267,628 | B2 * | 3/2022 | Smith | A45C 11/00 |
| 2002/0050119 | A1 | 5/2002 | Gatewood et al. | |
| 2002/0088855 | A1 | 7/2002 | Hodes | |
| 2002/0170842 | A1 | 11/2002 | Usui et al. | |
| 2003/0041963 | A1 | 3/2003 | Gong et al. | |
| 2003/0077470 | A1 | 4/2003 | Sammarco et al. | |
| 2003/0091760 | A1 | 5/2003 | Drogou et al. | |
| 2004/0040880 | A1 * | 3/2004 | Grosskopf | B65D 83/0445 220/4.23 |
| 2004/0045666 | A1 | 3/2004 | Gong et al. | |
| 2004/0071902 | A1 | 4/2004 | Santelli | |
| 2004/0086737 | A1 | 5/2004 | Yockey | |
| 2004/0105941 | A1 | 6/2004 | Terada et al. | |
| 2004/0163768 | A1 | 8/2004 | Nowicki et al. | |
| 2004/0164134 | A1 | 8/2004 | Gong et al. | |
| 2004/0166238 | A1 | 8/2004 | Nowicki et al. | |
| 2004/0166257 | A1 | 8/2004 | Pierce et al. | |
| 2004/0202832 | A1 | 10/2004 | Nigam et al. | |
| 2005/0027026 | A1 | 2/2005 | Kinoshita | |
| 2005/0091115 | A1 | 4/2005 | Arthur | |
| 2005/0139505 | A1 | 6/2005 | Miller et al. | |
| 2005/0279825 | A1 | 12/2005 | Ashby et al. | |
| 2006/0000734 | A1 | 1/2006 | Ninomiya et al. | |
| 2006/0000878 | A1 | 1/2006 | Labbe et al. | |
| 2006/0151348 | A1 | 7/2006 | Willard | |
| 2006/0151350 | A1 | 7/2006 | Tilton | |
| 2006/0154012 | A1 | 7/2006 | Ashton et al. | |
| 2006/0194004 | A1 | 8/2006 | Niemoller et al. | |
| 2006/0261154 | A1 | 11/2006 | Arthur et al. | |
| 2006/0263596 | A1 | 11/2006 | Bamborough et al. | |
| 2007/0034543 | A1 | 2/2007 | Jones | |
| 2007/0051652 | A1 | 3/2007 | Tilton | |
| 2007/0062836 | A1 * | 3/2007 | Nazari | B65D 73/0092 206/461 |
| 2007/0063021 | A1 * | 3/2007 | Chakiris | B42D 15/045 235/487 |
| 2007/0088116 | A1 | 4/2007 | Abba et al. | |
| 2007/0125678 | A1 | 6/2007 | Green | |
| 2007/0137789 | A1 | 6/2007 | Jokela et al. | |
| 2007/0160833 | A1 | 7/2007 | Maak et al. | |
| 2007/0187273 | A1 | 8/2007 | Grosskopf | |
| 2007/0278293 | A1 | 12/2007 | Anderson et al. | |
| 2007/0278296 | A1 | 12/2007 | Dwyre et al. | |
| 2008/0067099 | A1 | 3/2008 | Young | |
| 2008/0086982 | A1 | 4/2008 | Parenteau et al. | |
| 2008/0132625 | A1 | 6/2008 | Niehaus et al. | |
| 2008/0191174 | A1 | 8/2008 | Ehrensvard et al. | |
| 2008/0206505 | A1 | 8/2008 | Blackwell et al. | |
| 2008/0237317 | A1 | 10/2008 | Rosendall | |
| 2009/0011192 | A1 | 1/2009 | Tomczyk et al. | |
| 2009/0065138 | A1 | 3/2009 | Engel et al. | |
| 2009/0078590 | A1 | 3/2009 | Smith | |
| 2009/0091123 | A1 | 4/2009 | Conley et al. | |
| 2009/0142981 | A1 | 6/2009 | Arendt et al. | |
| 2009/0322478 | A1 | 12/2009 | Walther et al. | |
| 2011/0119267 | A1 | 5/2011 | Forman et al. | |
| 2014/0116908 | A1 | 5/2014 | Beyer et al. | |

FOREIGN PATENT DOCUMENTS

| | | | |
|---|---|---|---|
| CA | 2472684 | A1 | 12/2005 |
| CA | 2472739 | A1 | 12/2005 |
| DE | 2935580 | A1 | 3/1981 |
| DE | 29824884 | | 4/2003 |
| DE | 102004007028 | A1 | 8/2005 |
| EP | 0115434 | A2 | 8/1984 |
| EP | 0559443 | A1 | 9/1993 |
| EP | 1163649 | A1 | 12/2001 |
| EP | 1377448 | A2 | 1/2004 |
| EP | 1425328 | A1 | 6/2004 |
| EP | 1985677 | A1 | 10/2008 |
| EP | 2046908 | A1 | 4/2009 |
| EP | 2092033 | A1 | 8/2009 |
| GB | 1203140 | A | 8/1970 |
| GB | 1454599 | A | 11/1976 |
| GB | 2231309 | A | 11/1990 |
| IT | 1045051 | B | 5/1980 |
| JP | 10762319 | A | 3/1995 |
| KR | 100261511 | B1 | 7/2000 |
| WO | 9815407 | A1 | 4/1998 |
| WO | 0037580 | A1 | 6/2000 |
| WO | 03046099 | A1 | 6/2003 |
| WO | 2006082478 | A2 | 8/2006 |

OTHER PUBLICATIONS

"Tack Measurement of Heat-Activated Polyurethane Adhesives", https://www.adhesivesmag.com/articles/86054-tack-measurement-of-heat-activated-polyurethane-adhesives, Nov. 1, 2005.

Brody, Aaron L., et al., "The Wiley Encyclopedia of Packaging Technology".

Cognard Philippe, "Handbook of Adhesives and Sealants", 2006.

Modern Plastics Encyclopedia , "Roll Coating", 1984, p. 198.

Patent Trial and Appeal Board , "Declaration of Paul Singh, Ph.D., CPP in Support of Petition for Inter Partes Review of U.S. Pat. No. 8,419,889", Inter Partes Review, 272 pages.

Patent Trial and Appeal Board , "Declaration of Robert M. Kimmel, Sc. D*", Case: IPR2017-01650, 86 pages.

Patent Trial and Appeal Board , "Deposition of Dr. Robert M. Kimmel", Case: IPR 2017-01650, Jun. 28, 2018, 93 pages.

Patent Trial and Appeal Board , "Final Written Decision Determining That Claims 1-30 Are Unpatentable", Case: IPR 2017-01650, Jan. 4, 2019, 47 pages.

Patent Trial and Appeal Board , "Patent Owner Sur-Reply To Petitioner's Reply To Patent Owner's Response", Case: IPR 2017-01650, 14 pages.

Patent Trial and Appeal Board , "Patent Owner's Preliminary Response Pursuant To 37 C.F.R. $ 42.107", Case: IPR 2017-01650, 74 pages.

Patent Trial and Appeal Board , "Patent Owner's Response Pursuant To 37 C.F.R. § 42.120", Case: IPR 2017-01650, 77 pages.

Patent Trial and Appeal Board , "Petition for Inter Partes Review of U.S. Pat. No. 8,419,889", Inter Partes Review, 83 pages.

Patent Trial and Appeal Board , "Petitioner's Reply To Patent Owner's Response", Case: IPR 2017-01650, 34 pages.

Patent Trial and Appeal Board , "Record of Oral Hearing", Case: IPR 2017-01650, 90 pages.

Patent Trial and Appeal Board , "Video-Recorded Deposition of S. Paul Singh, PH.D.", Case: IPR 2017-01650, Mar. 16, 2018, 365 pages.

Soroka Walter, "Fundamentals of Packing Technology".

U.S District Court for The, District of Colorado , "Exhibit B: American Express Prepaid Card Packaging", Case: 1:16-CV-02536-MEH, Jul. 17, 2018, 13 pages.

U.S. Discrict Court for The, District of Colorado , "Multi Packaging Solutions, Inc.'s Opening Claim Construction Brief", Case: 1:16-CV-02536-MEH, Jun. 28, 2017, 23 pages.

U.S. Disctrict Court for The, Disctrict of Colorado , "Defendant MPS's First Amended Answer, Defenses, and Counterclaims To Complaint for Patent Infringment", Case: 1:16-CV-02536-MEH, Dec. 13, 2016, 16 pages.

U.S. District Court for The, District of Colorado , "CPI Card Group, Inc.'S Responsive Claim Construction Brief", Case 1:16-CV-02536-MEH, Jul. 19, 2017, 20 pages.

(56) References Cited

OTHER PUBLICATIONS

U.S. District Court for The, Disctrict of Colorado , "Defendant MPS's Answer, Defenses, and Counterclaims To Complaint for Patent Infringment", Case: 1:16-CV-02536-MEH, Nov. 23, 2016, 16 pages.
U.S. District Court for The, District of Colorado , "Defendant MPS's Answer, Defenses, and Counterclaims to Amended Complaint for Patent Infringement", Case: 1:16-CV-02536-MEH, Jul. 31, 2018, 12 pages.
U.S. District Court for The, District of Colorado , "Exhibit 4: Declaration of Dennis Smith", 1:16-CV-02536-MEH, Jan. 6, 2017, 9 pages.
U.S. District Court for The, District of Colorado , "Exhibit C: Target's American Express Gift Card Packaging", Case: 1:16-CV-02536-MEH, Jul. 17, 2018, 12 pages.
U.S. District Court for The, District of Colorado , "Order Re: Claim Construction", 1:16-CV-02536-MEH, Oct. 23, 2017, 15 pages.
U.S. District Court for The, District of Colorado , "Plaintiff CPI Card Group Inc.'S Answer To Defendant's Counterclaims", Case: 1:16-CV-0202536-MEH, Jan. 3, 2017, 8 pages.
U.S. District Court for The, District of Colorado , "Plaintiff CPI Card Group-Minnesota, Inc.'S Answer To Defendant's Counterclaims", 1:16-CV-02536-MEH, Aug. 20, 2018, 6 pages.
U.S. District Court for The, District of Colorado , "Transcript of Audio Recorded Claim Construction Hearing", Case: 1:16-CV-02536-MEH, Nov. 2, 2017, 46 pages.
U.S. Patent and Trademark Office , "Declaration of Dennis R. Smith in Support of Non-Obviousness", Apr. 9, 2012, 4 pages.

* cited by examiner

ULTRASECURE CARD PACKAGE

CROSS-REFERENCE TO RELATED APPLICATIONS

This is a continuation of U.S. patent application Ser. No. 16/879,573, filed May 20, 2020, entitled "ULTRASECURE CARD PACKAGE", which is a continuation of U.S. patent application Ser. No. 14/704,067, filed May 5, 2015, entitled "ULTRASECURE CARD PACKAGE", now U.S. Pat. No. 11,034,497, which is a continuation of U.S. patent Ser. No. 13/852,286, filed Mar. 28, 2013, entitled "ULTRASECURE CARD PACKAGE," now U.S. Pat. No. 9,049,909, which is a continuation of U.S. patent application Ser. No. 13/083,178, filed Apr. 8, 2011, entitled "ULTRASECURE CARD PACKAGE", now U.S. Pat. No. 8,419,889, which is a continuation of U.S. patent application Ser. No. 12/017,227, filed Jan. 21, 2008, entitled "ULTRASECURE CARD PACKAGE", the entireties of which are hereby incorporated by reference.

BACKGROUND OF THE INVENTION

The present invention relates generally to secure point-of-sale activated cards, and more particularly, to packaging technology designed to deter theft and unaccountable activation of activatable point of sale cards.

The purchase, sale, and use of cards such as debit cards, gift cards, credit cards, telephone cards and the like has dramatically increased to the point where the cards are well known and their uses are widely recognized. At times, cards are printed and issued with a predetermined balance and typically sold as a retail item. However, a typical card is often stored or displayed in an inactivated state to reduce the risk of theft. This essentially renders the card valueless until it is activated by a retailer or another party upon purchase by the end user. Despite these security features, point of sale cards are still stolen, often by removing the card from its packaging. At other times, the theft can be more surreptitious. For example, the would-be thief may only remove a card from its packaging long enough to obtain identifying card data such as an account number or a PIN number, after which the card is returned to its packaging. In some instances, this information may be accessible without removing the card from the packaging. The thief can then wait until the card is activated and at that time gain unauthorized access to any value associated with the card.

In addition to cards, suppliers and/or retailers often desire to include additional material or information within the card packaging. For example, a card supplier will often include a set of terms and conditions of use or instructions for using the card on a separate sheet of paper. Although these inserts can be bulky, such as when multiple sheets or folded sheets of material must be included, it is desirable to include them inside the package with the card to prevent their loss and maintain a clean package appearance.

Packaging with enhanced security that is capable of indicating unauthorized access to a packaged card reduces shrinkage due to theft of card value. As cards become more widely used internationally, new challenges arise that call for new solutions.

SUMMARY OF THE INVENTION

One embodiment in accordance with the invention includes a secure card package with a first panel having an outer surface and an inner surface and a second panel having an outer surface and an inner surface. In this embodiment the inner surfaces of the panels face toward each other. There is a polymeric coating on the inner surfaces of the panels and an adhesive over the polymeric coating. A card is located between the first and second panels and the first and second panels are heated under pressure to activate the adhesive in a region substantially surrounding the card to card to enclose the card between the panels. The polymeric coating and adhesive could cover substantially all of the inners surfaces of the panel, the region substantially surrounding the card, or any other region as desired.

Another embodiment in accordance with the invention includes a secure card package with a first panel having an outer surface and an inner surface and a second panel having an outer surface and an inner surface. In this embodiment the inner surfaces of the panels face toward each other. There is a polymeric coating on the inner surfaces of the panels and an adhesive over the polymeric coating. A card is located between the first and second panels and the first and second panels are heated under pressure to activate the adhesive in a region substantially surrounding the card to card to enclose the card between the panels. In this embodiment at least one of the panels has a line of separation which upon separation defines a slot in the panel and provides access to the space between the panels. In some embodiments, the slot is dimensioned to allow passage of the card. In another embodiment one of the panels has a removable portion, and a line of separation defines the perimeter of the removable portion. In some embodiments having the removable portion, there is an adhesive on the removable portion for holding a card disposed within the space between the first and second panels.

Another embodiment in accordance with the invention includes a secure card package with a first panel having an outer surface and an inner surface and a second panel having an outer surface and an inner surface. In this embodiment the inner surfaces of the panels face toward each other. There is a polymeric coating on the inner surfaces of the panels and an adhesive over the polymeric coating. A card is located between the first and second panels and the first and second panels are heated under pressure to activate the adhesive in a region substantially surrounding the card to card to enclose the card between the panels. In this embodiment one of the panels has an aperture. The card has a data field disposed and is disposed such that at least a portion of the data field is viewable through the aperture in the panel.

Another embodiment in accordance with the invention includes a secure card package with a first panel having an outer surface and an inner surface and a second panel having an outer surface and an inner surface. In this embodiment the inner surfaces of the panels face toward each other. There is a polymeric coating on the inner surfaces of the panels and an adhesive over the polymeric coating. A card is located between the first and second panels and the first and second panels are heated under pressure to activate the adhesive in a region substantially surrounding the card to card to enclose the card between the panels. The polymeric coating of this embodiment includes low density polyethylene, linear low density polyethlyene, high density polyethlene and/or copolymers of polyethylene.

Another embodiment in accordance with the invention includes a secure card package with a first panel having an outer surface and an inner surface and a second panel having an outer surface and an inner surface. In this embodiment the inner surfaces of the panels face toward each other. There is a polymeric coating on the inner surfaces of the panels and an adhesive over the polymeric coating. A card is located between the first and second panels and the first and second panels are heated under pressure to activate the adhesive in a region substantially surrounding the card to card to enclose the card between the panels. The adhesive of this embodiment includes ethylene vinyl acetate.

Another embodiment in accordance with the invention involves a method of forming a secure card package. The method includes the steps of applying a polymeric coating to a surface of a first panel and a surface of a second panel and applying an adhesive over the polymeric coating on the panels. A card is positioned between the panels, with the coated surfaces of the panels facing toward each other and toward the card. The region of the panels around the card is pressed together and heated to activate the adhesive. In some embodiments of this method, an activation data field is placed on the card. Some embodiments may include inserting the card into a metalized sleeve.

In another embodiment in accordance with the invention, a secure card package has a card with a first panel and a second panel enclosing the card. There is a laminated layer bonding the two panels together in a region around the card. The laminated layer has a first polymer layer adjacent the first panel, a second polymer layer adjacent the second panel, and an adhesive layer between the first and second polymer layers. In some embodiments, the card may have an activation field.

In yet another embodiment in accordance with the invention, a secure card package has a card with a first panel and a second panel enclosing the card. There is a laminated layer bonding the two panels together in a region around the card. The laminated layer has a first polymer layer adjacent the first panel, a second polymer layer adjacent the second panel, and an adhesive layer between the first and second polymer layers. In some embodiments, the card may have an activation field. This embodiment has a third panel that is joined to edge-to-edge with the first panel. The third panel is adapted to move through a range of motion. The third panel may be moved to a first position wherein the third panel at least partially covers the first panel. The first panel is disposed between the second and third panels when in this first position. The third panel may also be moved into a second position where the third panel at least partially covers the second panel. The second panel is disposed between the first and third panels when in this second position. It is possible, but not necessary, to construct this embodiment from a sheet of material having a first fold line and a second fold line, wherein the first, second, and third panels are formed on the sheet with the first and second panels joined at the first fold line and the first and third panels joined at the second fold line.

In another embodiment in accordance with the invention, a secure card package has a card with a first panel and a second panel enclosing the card. There is a laminated layer bonding the two panels together in a region around the card. The laminated layer has a first polymer layer adjacent the first panel, a second polymer layer adjacent the second panel, and an adhesive layer between the first and second polymer layers. In some embodiments, the card may have an activation field. This embodiment has a third panel that is joined to edge-to-edge with the first panel. The third panel is adapted to move through a range of motion. The third panel may be moved to a first position wherein the third panel at least partially covers the first panel. The first panel is disposed between the second and third panels when in this first position. In some cases, an aperture on the first panel may be covered by the third panel in this position. The third panel may also be moved into a second position where the third panel at least partially covers the second panel. The second panel is disposed between the first and third panels when in this second position. In this embodiment the first panel has an aperture, the card has a data field on it, and the card is disposed such that the data field is viewable through the aperture.

In another embodiment in accordance with the invention a secure card package includes a first panel having an outer surface and an inner surface and a second panel having an outer surface and an inner surface. In this embodiment, the inner surfaces of the panels face toward each other. A heat activated adhesive is printed on the inner surface of the first panel. A card is disposed between the first and second panels. The first and second panels are heated under pressure to activate the adhesive in a region substantially surrounding the card to enclose the card between the panels.

In another embodiment in accordance with the invention a secure card package includes a first panel having an outer surface and an inner surface and a second panel having an outer surface and an inner surface. In this embodiment, the inner surfaces of the panels face toward each other. A heat activated adhesive is printed on the inner surface of the first panel using a printing roller, a flood coater, a Gravure press, a multi-roll printing system, or an Anilox roll system. A card is disposed between the first and second panels. The first and second panels are heated under pressure to activate the adhesive in a region substantially surrounding the card to card to enclose the card between the panels.

In another embodiment in accordance with the invention a secure card package includes a first panel having an outer surface and an inner surface and a second panel having an outer surface and an inner surface. In this embodiment, the inner surfaces of the panels face toward each other. A heat activated adhesive is printed on the inner surface of the first panel in a region substantially surrounding the card. A card is disposed between the first and second panels. The first and second panels are heated under pressure to activate the adhesive in a region substantially surrounding the card to enclose the card between the panels.

In yet another embodiment, a package for a point of sale card is disclosed. The package may include a first panel, a second panel coupled to the first panel by an activatable adhesive applied to one of the first panel or the second panel; and a card enclosure region defined between the first panel and the second panel, the card enclosure region configured to receive a point of sale card therein, wherein the activatable adhesive is selectively activated along a perimeter surrounding the card enclosure region to secure the first panel to the second panel together at the perimeter and prevent access to the card enclosure region without irreparable damage to the first panel or the second panel.

In another embodiment, a card assembly is disclosed. The card assembly including a point of sale activatable card and a package for receiving the point of sale activatable card. The package includes a first panel, a second panel, and adhesive applied to the first panel in a first region and activated in a second region smaller than the first region, the adhesive in the second region securing the first panel and the second panel together and defining a card reception space therebetween, the point of sale activatable card being positioned within the card reception space, where the point of sale activatable card is prevented from being removed from the card reception space without irreparable damage to the first panel and the second panel.

In another embodiment, a method for producing a card package is disclosed. The method includes printing an adhesive on a first region of a first panel, drying the adhesive, positioning a point of sale activatable card within a card region defined on the first panel, positioning a second panel over the first panel and the point of sale activatable card, and activating the adhesive in a second region surrounding the point of sale activatable card and the card region to define a sealed perimeter surrounding the perimeter of the point of sale activatable card, where the second region is smaller than the first region.

In another embodiment, a package for a point of sale card is disclosed. The package includes a first panel. The package further includes a second panel. The package further includes a card enclosure region defined between the first panel and the second panel. The card enclosure region is configured to receive a point of sale card. The package further includes a heat activatable adhesive applied to selected areas of one or both of the first panel or the second panel. The heat activatable adhesive is selectively activated along a perimeter surrounding the card enclosure region to secure the first panel the second panel together and prevent access to the card enclosure region without irreparable damage to the first panel or the second panel.

In another embodiment, a package for a point of sale card is disclosed. The package includes a first panel. The package further includes a second panel. The package further includes a card enclosure region defined between the first panel and the second panel. The card enclosure region is configured to receive a point of sale card. The package further includes a heat activatable adhesive applied to one or both of the first panel or the second panel. The heat activatable adhesive further includes a first activated portion and a second non-activated portion. The first activated portion is configured to secure the first panel the second panel together and prevent access to the card enclosure region without irreparable damage to the first panel or the second panel.

In another embodiment, a package for a point of sale card is disclosed. The package includes a first panel. The package further includes a second panel. The package further includes a card enclosure region defined between the first panel and the second panel. The card enclosure region is configured to receive a point of sale card. The package further includes a heat activatable adhesive applied to a region of one or both of the first panel or the second panel. The region of the heat activatable adhesive includes an activated inset portion configured to secure the first panel the second panel together and prevent access to the card enclosure region without irreparable damage to the first panel or the second panel.

DETAILED DESCRIPTION

Figure 1:
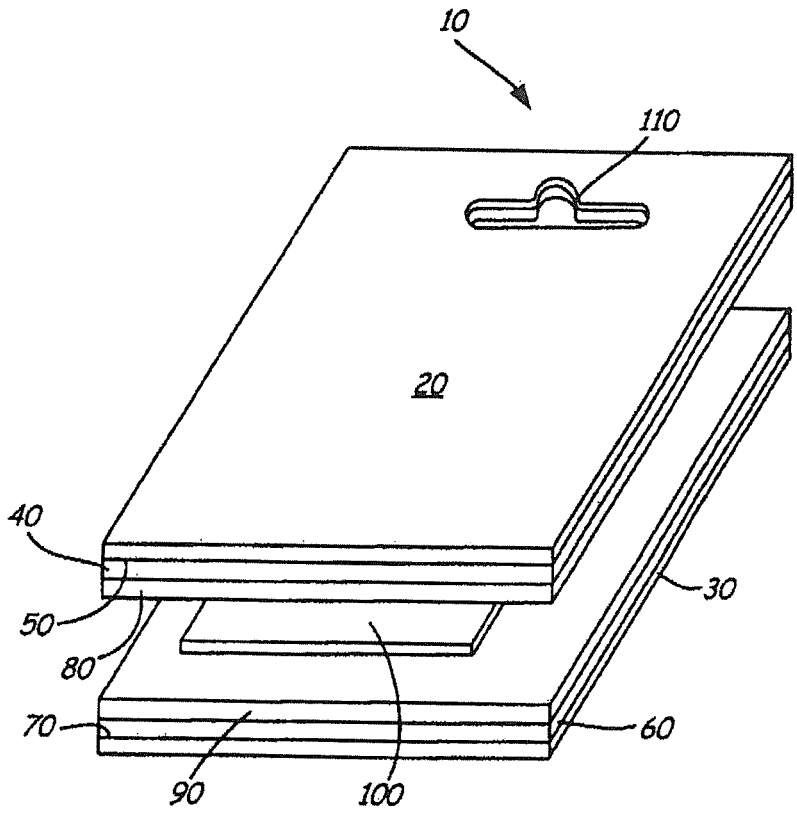
FIG. 1 is a perspective exploded view of a secure card package in accordance with embodiments of the invention.

The following detailed description should be read with reference to the drawings, in which like elements in different drawings are numbered identically. The drawings depict selected embodiments and are not intended to limit the scope of the invention. It will be understood that embodiments shown in the drawings and described below are merely for illustrative purposes, may not be to scale, and are not intended to limit the scope of the invention as defined in the claims.

FIG. 1 is a perspective exploded view of a secure card package in accordance with embodiments of the invention. The package 10 includes a first panel 20 and a second panel 30. The first panel has a polymeric coating 40 disposed on the inner surface 50 of the panel 20. The second panel 30 also has a polymeric coating 60 on its inner surface 70. An adhesive 80 is disposed over the polymeric coating 40 on the first panel, and an adhesive 90 is disposed over the polymeric coating 60 that is disposed on the second panel. In FIG. 1, adhesive is shown as being disposed initially on both panels. For ease of manufacturing this might be a typical case, but the adhesive could also be disposed on only one of the panels prior to enclosing the card. An aperture 110 may be formed through all of the layers to allow for hanging the package on a display rack.

A card 100 is disposed between the first and second panels. The card could be a point of sale activated phone or gift card, a credit or debit card, or any type of stored value card or other card where security of the card is an issue. The package may also include documentation as to how to use the card or redeem card value as well as terms and conditions regarding the card agreement or other documentation (not shown). This documentation may make the material stored in the card somewhat bulky, so a polymer and adhesive combination that securely fastens the panels despite the pressure exerted by the sometimes bulky enclosed components is used.

The panels themselves may be made of any suitable material. One exemplary material is a bleached paperboard substrate used in packaging of foods and other products. Such panels may be clay coated and/or otherwise treated on the outer surface to improve printability, smoothness, and other desired characteristics.

The polymeric coating is applied to the inner surfaces of the panel, which may be uncoated. The polymeric coating may be applied to essentially the entire inner surface of the panel, or to selected areas or regions depending on the application. The polymer layer may be a polyolefin, and polyolefins known to effectively work with embodiments of the invention include low density polyethylene (LDPE), linear low density polyethylene (LLDPE), high density polyethlene (HDPE) and copolymers of polyethylene (PE).

The adhesive may be applied over the polymeric coating. An ethylene vinyl acetate has been found to be effective, as have laminating adhesives based on polyurethane, but other adhesives such a ethylene methyl acrylate, and other acrylic copolymer adhesives are also contemplated. The adhesive may include additives that improve adhesive performance or otherwise improve the performance of the packaging.

The combination of a polymeric layer with the adhesive layer may have several benefits such as a thinner and lighter adhesive layer due to the synergistic relationship between the two layers. Also, because adhesive is typically more expensive than the polymeric layer, the use of less adhesive or a substitution of some adhesive for polymer may reduce production costs.

Panels in accordance with embodiments of the invention may be produced from sheets of feedstock that are then cut to the desired size by die cutting or other means known in the art. In some embodiments, a feedstock such as paperboard is fed from a feed roll past polymer application devices as are known in the art. The polymer may be, for example, extruded onto the feedstock. The adhesive may be applied over the polymer in the same manner, and the feedstock with polymer and adhesive layers may be rolled back up for transport to other facilities for further processing such as printing, die cutting, and/or production of the final packaging.

Figure 2:
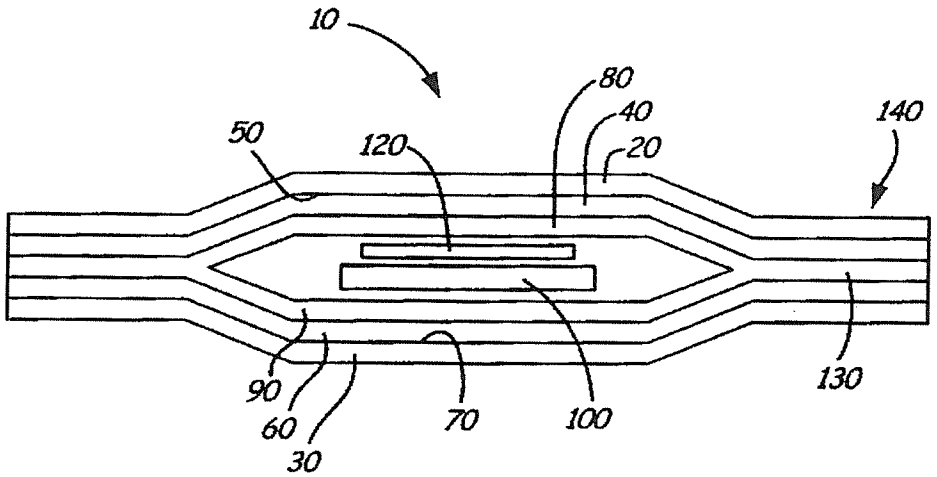
FIG. 2 is a cross section of a secure card package in accordance with embodiments of the invention.

FIG. 2 is a cross section of a secure card package in accordance with embodiments of the invention. The package 10 includes a first panel 20 and a second panel 30. The first panel has a polymeric coating 40 disposed on the inner surface 50 of the panel 20. The second panel 30 also has a polymeric coating 60 on its inner surface 70. An adhesive 80 is disposed over the polymeric coating 40 on the first panel, and an adhesive 90 is disposed over the polymeric coating 60 that is disposed on the second panel. A card 100 is disposed between the first and second panels. Additional enclosures 120, such as instructions or terms and conditions for the use of the card may also be included in the package. More than one card could also be included depending on the application. In FIG. 2, adhesive is shown as being disposed substantially over the entire surface of both panels. For ease of manufacturing this might be a typical case, but the adhesive could also be disposed on only one of the panels prior to enclosing the card.

The embodiment of FIG. 2 shows a laminated layer 140 bonding the two panels together in a region around the card 100. The laminated layer has a first polymer layer 40 adjacent the first panel 20, a second polymer layer 60 adjacent the second panel 30, and an adhesive layer 130 between the first and second polymer layers. The layers of the laminate may not be as distinct as is shown in FIG. 2 due to mixing and intermingling that occur during the bonding process.

Card packages constructed in this fashion may be extremely secure because the combination of polymeric layers and adhesive layers creates a bond with the material that is difficult to infiltrate without irreparably damaging the panel. In cases where the panels include a paperboard substrate, the polymeric layer includes polyethylene, and the adhesive includes ethylene vinyl acetate, among others, the enclosure can be so robust that it is virtually impossible to remove the card from the package without irreparably damaging one or both of the panels. This construction effectively prevents thieves from slicing the package apart at the interface between the panels, removing the card to acquire data from the card, and returning the card to the package for sale to an unsuspecting customer. In some cases a narrow strip of tensilized polypropylene or other filament may be pre-applied to either panel of the package. Such a filament is commonly used in express mail envelopes such as those used by Federal Express® to allow easier opening of the envelopes. This allows the consumer to open the package without the need for scissors. It opens the package cleanly, yet does enough damage to insure tamper evidence.

Figure 3:
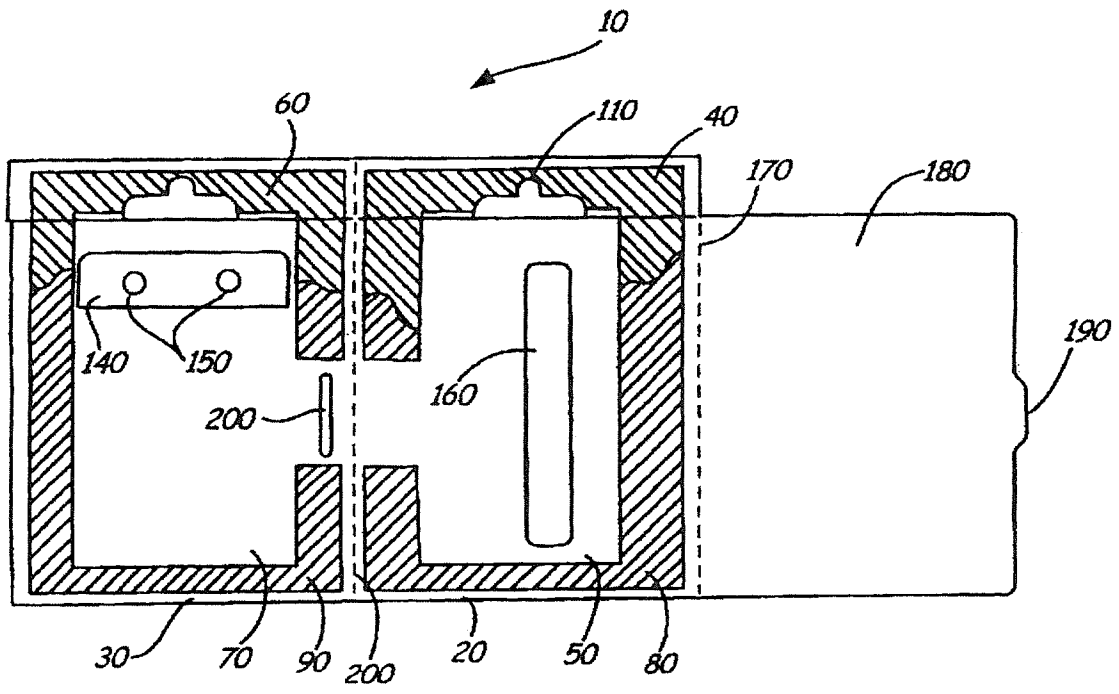
FIG. 3 is a modified plan view of a secure card package in accordance with embodiments of the invention.

FIG. 3 is a modified plan view of a secure card package in accordance with embodiments of the invention. The secure card package shown in FIG. 3 is capable of holding one or more cards and/or documents between a first panel 20 and a second panel 30. The first panel 20 has a polymeric layer 40 disposed thereon. An adhesive layer 80 is disposed over the polymeric layer. In FIG. 3, a portion of the adhesive layer 80 is removed to expose the polymeric layer 40. The polymeric layer 40 and adhesive layer 80 are shown as disposed generally around a central area of the first panel 20 and near the perimeter of the first panel 20. This arrangement is merely one example, and the polymeric layer 40 and adhesive layer 80 could cover essentially the entire first panel 20 or any appropriate portion thereof. Similarly, a polymeric layer 60 and adhesive layer 90 are located on second panel 30.

To form the secure card package from the elements shown in FIG. 3, a card and/or other material may be placed between the first 20 and second 30 panels, with the first 20 and second 30 panels oriented so that their inner surfaces 50, 70 are facing each other. The panels may then be pressed together and heated to form a laminated layer bonding the two panels together in a region around the card and/or other material. The laminated layer is formed from the first polymer layer 40 adjacent the first panel 20, the second polymer layer 60 adjacent the second panel 30, and adhesive layer between the first and second polymer layers formed from the adhesive layers 80 and 90.

The embodiment in FIG. 3 also includes an aperture 160 in the first panel 10. In some instances, the card or other contents of the package (not shown) may include a data field of human- and/or machine-readable data. In cases where a card is used as a stored value card, the data field may be used to activate an account associated with the card. The card or other contents may be disposed so that the data field can be viewed through the aperture 160 without removing the contents from the package. A similar aperture could be used with any of the embodiments described herein or covered by the claims below.

The embodiment of FIG. 3 includes a third panel 180 with at least one edge. The at least one edge of the third panel is joined to at least one edge of the first panel at junction 170. Junction 170 may be a fold line formed in a single sheet of material, but the panels may, be joined in any manner known in the art.

The third panel 180 is adapted to move through a range of motion even while the first 20 and second 30 panels are fastened together to enclose the card and/or other contents of the package. This range of motion includes a first position wherein the third 180 panel at least partially covers the first panel 20. The panels may be joined so that the third panel 180 can rotate or move about an axis coaxial with the junction 170. When the third panel 180 is in this first position, the first panel 20 is disposed generally between the second 30 and third 180 panels. In some embodiments that include the aperture 16, the third panel 180 may cover the aperture when in the first position of the range of motion.

The third panel 180 may also be moved to a second position. In this second position the third panel 180 at least partially covers the second panel 30, the second panel 30 being disposed between the first 20 and third 180 panels when in the second position.

In some embodiments, the third panel 180 can be secured to either or both the first and second positions by any suitable fastener known in the art. FIG. 3 shows a tab 190 and a slot 200 may cooperate to hold the third panel 180 in this second position. In another embodiment, a releasable adhesive can be disposed on the second panel 30 and/or the third panel 180 for fastening the panels together in the second position. In yet another embodiment, the third panel 180 can first be held to the second panel by a releasable adhesive, and then refastened to the second panel at a later time with the slot 200 and tab 190 depicted in FIGS. 1 and 2. In some embodiments, the third panel 180 can be similarly secured against the back surface of first panel 20 using any of these or other known fasteners.

The three panels of the embodiment shown in FIG. 3 may be formed from a unitary sheet of material. This sheet has a first fold line 200 and a second fold line at junction 170, wherein the first 20, second 30, and third 180 panels are formed on the sheet with the first 20 and second 30 panels joined at the first fold line 200 and the first 20 and third 180 panels joined at the second fold line at junction 170.

The movement of the third panel 180 can advantageously add to the aesthetics, functionality, and/or security of the package assembly 10. For example, in one embodiment, the third panel 180 can be fastened against the second panel 30 with a non-resealable adhesive, thus making an attempt to access the card by lifting the third panel detectable. In another embodiment, a retailer or other person may detach the removable portion 140 of the second panel 30 in order to access and activate the card. After the card has been activated, it can be placed back through the slot created by the removable portion 140, and the third panel 180 can be fastened against the second panel 30. Thus, the third panel can conceal the separated line and/or the removed portion and maintain a pleasing appearance when the package is presented to a recipient, while the separation of the removable portion 140 from the second panel 30 creates a difficult to mask indicator that the contents have been removed from the package.

In some embodiments, a supplier or retailer can include indicia on the second panel 30 which can be concealed at appropriate times by the third panel 180. For example, a retailer may desire to include promotional indicia, advertising, instructional indicia or other indicia on the second panel 30 and yet desire to conceal that indicia at times. The third panel 180 can be fastened in the first position against the first panel 20 in order to facilitate viewing of the second panel, and then unfastened and moved into the second position and fastened to the second panel 30 as previously described in order to conceal any indicia on the second panel 30. Indicia placed on the first panel 20 can similarly be concealed by moving the third panel 180 from the second position into the first position against the first panel 20. In addition, some embodiments include indicia on the third panel 180 that can alternately be viewed or concealed depending upon which surface of the third panel the indicia is on.

Figure 4:
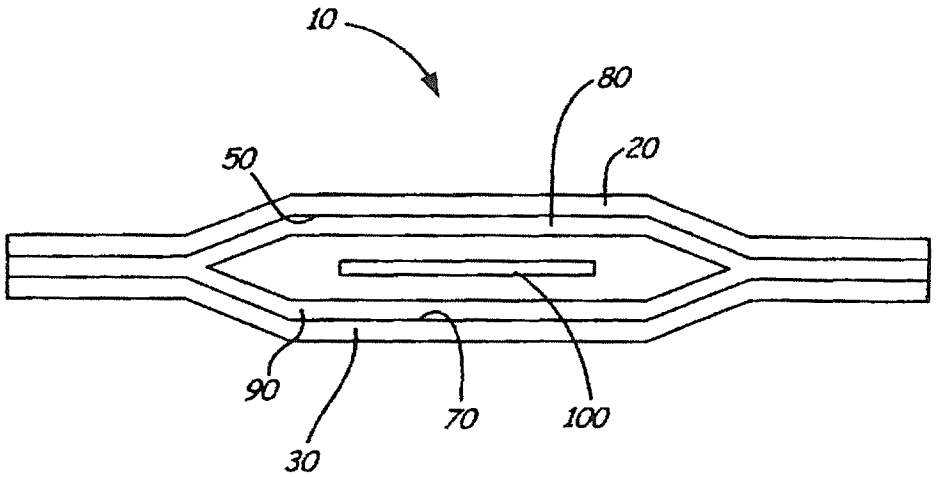
FIG. 4 is a cross section of a secure card package in accordance with the invention.

FIG. 4 is a cross section of a secure card package in accordance with the invention. The package 10 includes a first panel 20 and a second panel 30. The first panel has an adhesive 80 disposed on the inner surface 50 of the panel 20. The second panel 30 also has an adhesive 90 on its inner surface 70. In FIG. 4, adhesive 80, 90 is shown as being disposed initially on both panels 20, 30. For ease of manufacturing this might be a typical case, but the adhesive could also be disposed on only one of the panels prior to enclosing the card.

A card 100 is disposed between the first and second panels. The card could be a stored value card or other card where security of the card is an issue. The package may also include documentation as to how to use the card or redeem card value as well as terms and conditions regarding the card agreement or other documentation (not shown).

The panels could be any suitable paper board or plastic stock, but one embodiment uses solid bleached sulfate paper stock that is clay coated on both sides (C2S SBS), or a similar coated board stock. The adhesive is a heat activated adhesive and is applied directly to the clay coated inner surfaces. The adhesive may be applied to substantially all of the inner surface 50, 70 of the panels 20, 30 in selected areas. The embodiment of FIG. 4 can produce similar packages to the embodiments of FIGS. 1-3, but without the polymeric layers described above.

The heat activated adhesive of FIG. 4 is more properly described as a coating than a glue. One suitable coatings is Coatings & Adhesives' 204 Heat Seal coating (polyurethane) available from Coating and Adhesives Corporation of Leland, N.C. The adhesive is applied using known printing techniques such as a printing roller, a flood coater, a Gravure press, Anilox roller plates, or analogous techniques. By contrast, glues in automated systems are usually applied by squirt nozzles and spread by pressure rollers. Where the heat activated adhesives can be applied in virtually any pattern that printing ink can be applied, glue can be applied in a line along the direction of travel of a feedstock or as a dot. To apply a line of glue to a package transverse to the line of travel of a feedstock, a line of dots must be applied from a row of nozzles turning on and off quickly.

The heat activated adhesives used in these embodiments are applied to the cardstock in the normal printing process and allowed to dry to be activated later. Glues, by comparison, are applied as part of the package assembly with the card 10 and other components because the assembly has to take place before the glue has an opportunity to dry. The heat activated adhesive can be applied to the entire surface of the panel, and only activated selectively by heating only the portions of the panels that are to be bonded. With glues, care must be taken to avoid allowing the glue to contact the package contents and adhere to them. This fact, combined with the above-discussed ease of controlled application of the heat activated adhesives provide for more efficient production of packages and lower reject rates.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A package for a point of sale card comprising:

a first panel;

a second panel;

a card enclosure region defined between the first panel and the second panel, the card enclosure region configured to receive a point of sale card; and a heat activatable adhesive applied to selected areas of one or both of the first panel or the second panel, wherein the heat activatable adhesive is selectively activated in an activated area, wherein the activated area extends along a perimeter surrounding the card enclosure region to secure the first panel the second panel together and prevent access to the card enclosure region without irreparable damage to the first panel or the second panel, wherein the selected areas of the first panel and the second panel including the heat activatable adhesive are larger than the activated area of the heat activatable adhesive.

2. The package of claim 1, wherein the heat activatable adhesive is selectively activated along the perimeter by heating a portion of the first panel and the second panel.

3. The package of claim 2, wherein the heat activatable adhesive prevents the first panel and the second panel from separating at the portion without irreparable damage to the first panel or the second panel.

4. The package of claim 1, wherein the heat activatable adhesive is selectively activated along the perimeter such that selected portions of the heat activatable adhesive are activated, thermally, and other selected portions of the heat activatable adhesive remain non-activated.

5. The package of claim 1, wherein the selected areas of the first panel and the second panel comprise an entirety of a surface of one or both of the first panel or the second panel.

6. The package of claim 1, wherein the heat activatable adhesive is selectively activated along the perimeter such that the card enclosure region is surrounded by activated, heat-activatable adhesive.

7. The package of claim 6, wherein the activated, heat-activatable adhesive is arranged adjacent non-activated, heat-activatable adhesive.

8. The package of claim 1, wherein the first panel defines an aperture positioned over the card enclosure region such that a portion of the point of sale card is viewable through the aperture.

9. A package for a point of sale card comprising a first panel;

a second panel;

a card enclosure region defined between the first panel and the second panel, the card enclosure region configured to receive a point of sale card; and a heat activatable adhesive applied to one or both of the first panel or the second panel;

wherein the heat activatable adhesive comprises a first activated portion and a second non-activated portion, the first activated portion configured to secure the first panel the second panel together and prevent access to the card enclosure region without irreparable damage to the first panel or the second panel, wherein the first activated portion is disposed along a perimeter of the card enclosure region and the second non-activated portion extends outside of the perimeter.

10. The package of claim 9, wherein the first activated portion is inset in the second non-activated portion.

11. The package of claim 9, wherein the heat activatable adhesive is applied to selected areas of one or both of the first panel or the second panel.

12. The package of claim 9, wherein the heat activatable adhesive comprises an ethylene vinyl acetate, a polyurethane, or an ethylene methyl acrylate.

13. The package of claim 12, wherein the heat activatable adhesive is selectively applied by a printing or coating process to one or both of the first panel or the second panel.

14. A package for a point of sale card comprising a first panel;

a second panel;

a card enclosure region defined between the first panel and the second panel, the card enclosure region configured to receive a point of sale card; and a heat activatable adhesive applied to a region of one or both of the first panel or the second panel;

wherein the region of the heat activatable adhesive includes an activated inset portion configured to secure the first panel the second panel together and prevent access to the card enclosure region without irreparable damage to the first panel or the second panel and the activated inset portion is inset within a non-activated region of the heat activatable adhesive.

15. The package of claim 14, wherein the activated inset portion is arranged along a perimeter of the card enclosure region.

16. The package of claim 15, wherein the activated inset portion surrounds the card enclosure region.

17. The package of claim 14, wherein the heat activatable adhesive is selectively applied to one or both of the first panel or the second panel.

* * * * *